United States Patent [19]

Ollis et al.

[11] 4,001,913

[45] Jan. 11, 1977

[54] DOOR MOUNTING

[76] Inventors: William John Bernard Ollis, 6A Church End, Haddenham, Bucks; Clive Beech Ansley Long, Newtons Farms Widemer End, High Wycombe, Buckinghamshire, both of England

[22] Filed: Dec. 17, 1974

[21] Appl. No.: 533,628

[52] U.S. Cl. ..... 16/88; 16/151; 49/388

[51] Int. Cl.[2] ..... E05D 15/06

[58] Field of Search ..... 16/129, 151, 152, 86.1, 16/154, 156, 163, 168, 166, 88; 49/388

[56] References Cited

UNITED STATES PATENTS

| | | | |
|---|---|---|---|
| 680,054 | 8/1901 | Manlove | 16/156 X |
| 696,027 | 3/1902 | Foster | 16/151 X |
| 708,214 | 9/1902 | Foster | 16/151 X |
| 842,668 | 1/1907 | Huey | 16/151 |
| 1,045,284 | 11/1912 | Haun | 16/88 |
| 1,312,667 | 8/1919 | Ayres | 16/151 X |
| 1,610,648 | 12/1926 | Armitage et al. | 16/151 |
| 2,255,529 | 9/1941 | May | 16/129 |
| 2,928,116 | 3/1960 | Bengtsson | 16/166 X |
| 3,320,699 | 5/1967 | Carson et al. | 49/388 |
| 3,478,383 | 11/1969 | Brooks | 16/151 |
| 3,825,324 | 11/1966 | Stein et al. | 16/151 X |
| 3,828,394 | 8/1974 | Horgan | 49/388 X |
| 3,866,658 | 2/1975 | Smith | 16/151 X |

*Primary Examiner*—George H. Krizmanich
*Attorney, Agent, or Firm*—Watson, Cole, Grindle & Watson

[57] ABSTRACT

This is a door mounting consisting of a pair of hinges, each hinge having a component for mounting in the frame and a component for mounting on the door. The top hinge has a member for the door with a part-spherical recess for a corresponding head on a pin depending from the member on the frame so that the pin acts as a universal joint which can support the whole weight of the door. The lower hinge comprises depdning pins from the bottom edge of the door and a plate for sinking in the floor and having two arcuate slots, one for each of the depending pins. One or other pin defines a lower pivot point to one side of the top hinge axis and the other runs on its arcuate slot. The door can open either way and has a self-closing force.

6 Claims, 4 Drawing Figures

DOOR MOUNTING

This invention relates to door mounting, and one object is to provide a simple hinge mounting which enables the door to be capable of opening in either direction and to have a self-closing action.

According to the invention a door mounting comprises top and bottom hinges each having a component for attachment to a door and a component for attachment to a door frame, one of which hinges defines a single substantially vertical hinge axis and the other of which defines two alternative laterally-spaced substantially vertical axes. The effect will be for opening of the door to be about an axis which is slightly inclined to the vertical so that opening will be against gravity, which will then act to provide a selfclosing force.

Preferably the single axis hinge is the top hinge and has hinge members which are capable of transferring the whole weight of the door to the head of the frame. The members may be a pin having a part spherical head, and a plate having a part spherical seat to allow the top hinge axis to be aligned with which ever bottom hinge axis is being used.

The two axis hinge may comprise one hinge member in the form of a plate having a pair of arcuate guides, each centred about a point in the other guide, and a second hinge member including a pair of pins each arranged to move along a different one of the guides during opening of the door in a different sense.

The door post need not be made arcuate or be otherwise adapted to be suitable for 180° opening.

Any of the door or frame edges may be fitted with a fire restricting strip for example as described in British Patent Specification No. 1,220,404.

The invention may be carried into practice in various ways and one embodiment will be described by way of example with reference to the accompanying drawings, in which.

The door 11 is suspended in a frame by a top support in the head and a bottom guide in the sill or floor. The top support defines a range of substantially vertical hinge axes 12 through the central plane of the door close to the door post 10; the bottom guide defines two substantially vertical axes 13 within the range referred to and at equal distances on either side of, and lying in a vertical plane perpendicular to, the plane of the door.

Figure 4:
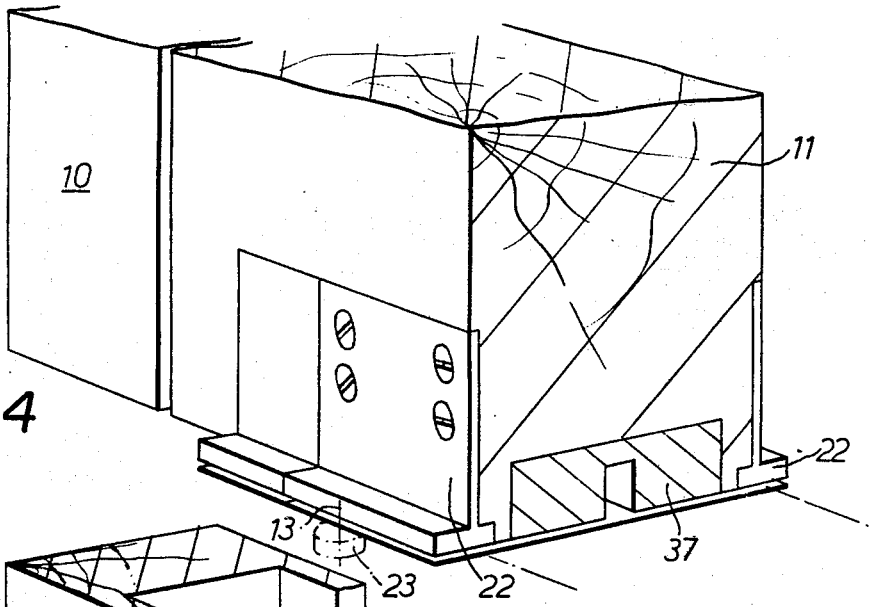
FIGS. 3 and 4 show respectively the bottom guide plate and the bottom of the door.
Figure 3:
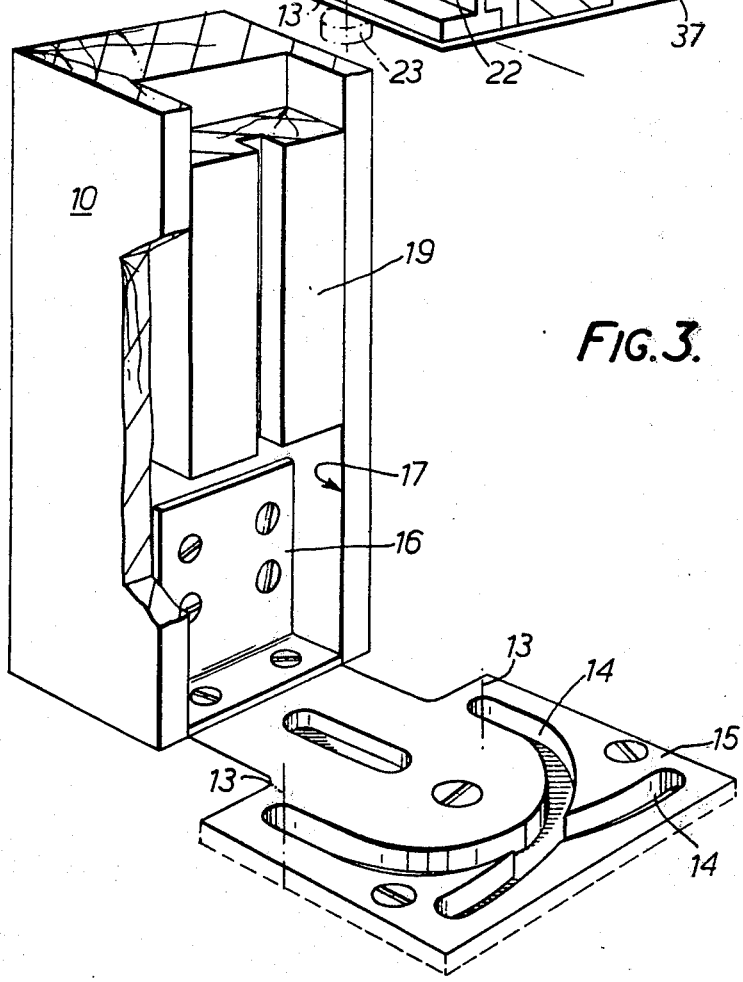

These axes 13 are at the inner ends 140 and 140' of two circular arcuate slots 14 and 14' in a floor plate 15 sunk into the sill or floor, and co-operating with an angle bracket 16 sunk into a vertical recess 17 in the door post 10, and subsequently covered by a fire restricting strip 19 which is slid down in the recess 17 after the flange 16 has been fixed in the door post 10. The door 11 has a pair of T-section brackets 22 secured at either side of its lower edge close to the door post 10, and each of these brackets has a bolt with a downwardly protruding head carrying a roller 23 shown diagrammatically in FIG. 4. When the door is closed, each roller 23 is at the inner end 140 of one of the slots 14. As the door is opened one of the rollers stays at such inner end of its slot and defines a pivot point, while the other is guided along its circular arc which is centred on the said pivot point. Such other roller moves into one of the slot extensions 14*a*, 14'*a* depending on the direction in which the door is opened. Such direction determines which roller remains at the end of its slot defining the pivot point.

Figure 1:
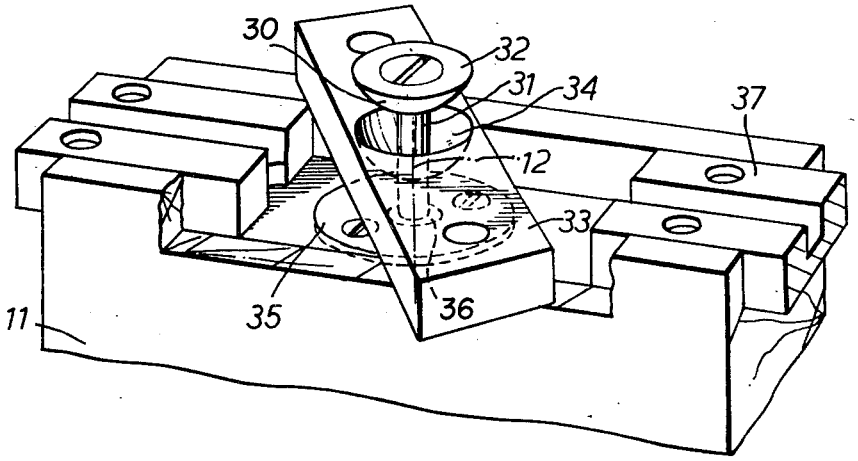
FIGS. 1 and 2 show two stages in the fitting of the top support.
Figure 2:
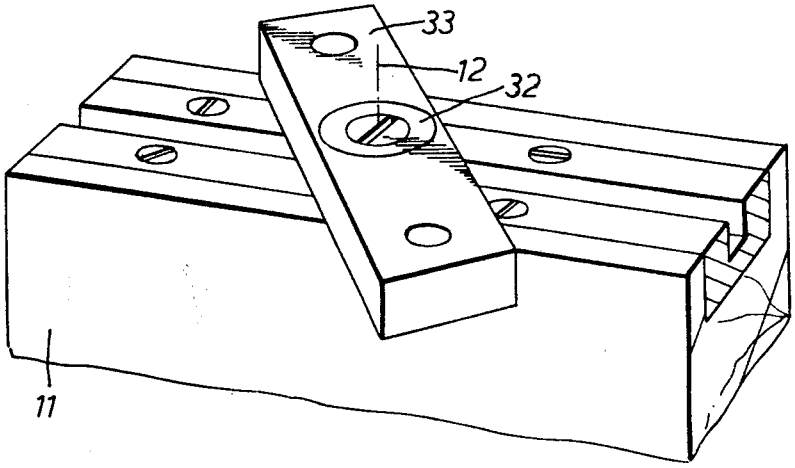

The top support consists of a vertical pin 31 secured in the top of the door and having an enlarged head 32 with an underneath surface 30 which is part spherical, and a bar 33 which is fixed in a recess routed in the underside of the frame head and has in its upper face a part spherical recess 34 for the head 32, as clearly shown in FIG. 1A. A universal joint is thereby defined at the top support.

The position of the bar 33 is marked in the frame head and holes are drilled in the head for cheesehead bolts for fixing the bar in that position. Threaded sleeves are inserted in those holes. Then the pin 31 is screwed into a bore in the top of the door and locked in position by means of a circular plate 35 which is screwed down the pin 31 into a counter bore in the door top and a screwed locking plate 36 which is screwed into a counter bore in the plate 35 and locked against it by use of a suitable spanner or the equivalent. The depth at which the pin is locked is chosen to give the desired spacing between the top of the door and the head when the assembly is complete.

The door is then fitted into the frame in the fully open position so that the bar 33 can be sunk into its recess in the head and the screws can be screwed into the threaded sleeves in their holes using a screw driver on either side of the open door. If the door has a firerestricting strip 37, that will be slid over the plate 35 after it has been locked and before the door is fitted in the frame.

The top support takes the full weight of the door, and after the door is hanging, the brackets 22 are fitted to the sides of the bottom of the door with the rollers 23 located in their slots.

It will be appreciated that since the lower axes 13 are on either side of the top axis 12, opening of the door will require movement against gravity, so that if it is not held, the door will tend to close itself.

What we claim as our invention and desire to secure by Letters patent is:

1. A two-way opening door mounting comprising top door support means and a bottom door guide means each having a component respectively for attachment to a door and a component for attachment to a door frame, wherein said support means include a pin and a seat having cooperating part spherical sliding bearing surfaces which define a range of substantially vertical hinge axes, said bearing surface of said seat facing away from said guide means and being located in said top support component, and said door guide means define two alternative laterally-spaced substantially vertical axes, whereby substantially the whole weight of a door is supported from the head of its frame by said door support means, and whereby said guide means serves to guide the opening of said door in each of opposite directions.

2. A mounting as claimed in claim 1, said components being mounted respectively on the door and door frame, said alternative axes lying within the range of said vertical hinge axes.

3. A mounting as claimed in claim 2 in which said pin is mounted in the top of the door, and the seat is defined in a plate mounted in the head of the frame.

4. A mounting as claimed in claim 3 in which said door guide means comprise one hinge member in the form of a plate having a pair of arcuate guides, each centered about a point in the other guide, and a second hinge member including a pair of pins each arranged to move along a different one of the guides during opening of the door in a different sense.

5. A mounting as claimed in claim 1 in which said door guide means comprise one hinge member in the form of a plate having a pair of arcuate guides, each centered about a point in the other guide, and a second hinge member including a pair of pins each arranged to move along a different one of the guides during opening of the door in a different sense.

6. A mounting as claimed in claim 1 including a fireresistant strip mounting along an edge of the door and/or the frame.

* * * * *

UNITED STATES PATENT OFFICE
CERTIFICATE OF CORRECTION

PATENT NO. : 4,001,913

DATED : January 11, 1977

INVENTOR(S) : William John Bernard Ollis & Clive Beech Ansley Long

It is certified that error appears in the above-identified patent and that said Letters Patent are hereby corrected as shown below:

On the Title Page, column 1, insert --Claims Priority British Application No. 58546/73, filed December 18, 1973--

Signed and Sealed this

*fifth* Day of *July 1977*

[SEAL]

*Attest:*

RUTH C. MASON
*Attesting Officer*

C. MARSHALL DANN
*Commissioner of Patents and Trademarks*